US005813064A

United States Patent [19]

Hartenstine

[11] Patent Number: 5,813,064

[45] Date of Patent: Sep. 29, 1998

[54] PORTABLE PLAYYARD STORAGE SYSTEM

[75] Inventor: Curtis Michael Hartenstine, Morgantown, Pa.

[73] Assignee: Graco Children's Products Inc., Eleverson, Pa.

[21] Appl. No.: 694,475

[22] Filed: Aug. 7, 1996

[51] Int. Cl.[6] ..... A47D 7/00; A47D 15/00

[52] U.S. Cl. ..... 5/99.1; 5/658; 206/38

[58] Field of Search ..... 5/99.1, 98.1, 93.1, 5/658, 663; 206/38, 315.1, 216; 150/154, 158

[56] References Cited

U.S. PATENT DOCUMENTS

| | | | |
|---|---|---|---|
| D. 207,302 | 4/1967 | Lerner | D5/5 |
| D. 279,525 | 7/1985 | Allen | D3/71 |
| D. 280,044 | 8/1985 | Allen | D3/48 |
| D. 336,218 | 6/1993 | Hague | D7/616 |
| D. 350,648 | 9/1994 | Gabriel-Lacki et al. | D6/331 |
| 1,782,217 | 11/1930 | Stoddard | 5/99.1 |
| 2,600,501 | 6/1952 | Higgs | 128/1 |
| 2,626,407 | 1/1953 | Kurry | 5/99.1 |
| 2,823,390 | 2/1958 | Hagelfeldt | 5/99.1 |
| 3,018,493 | 1/1962 | Wittbrodt | 5/99.1 |
| 3,122,225 | 2/1964 | Ward | 190/52 |
| 3,336,608 | 8/1967 | Lerner | 5/99.1 |
| 4,811,437 | 3/1989 | Dillner et al. | 5/99.1 |
| 5,060,767 | 10/1991 | Pulichino, Jr. et al. | 190/111 |
| 5,170,826 | 12/1992 | Carstensen et al. | 150/154 |
| 5,413,199 | 5/1995 | Clement | 190/108 |
| 5,586,345 | 12/1996 | Nielsen et al. | 5/99.1 |
| 5,644,806 | 7/1997 | Mariol et al. | 5/93.1 |

*Primary Examiner*—Alexander Grosz

*Attorney, Agent, or Firm*—Richard B. O'Planick; Lisa B. Riedesel

[57] ABSTRACT

An improved storage system for a juvenile playyard is disclosed. The system generally includes a playyard structure for a child and a carrying case. In the folded position, the playyard structure is disposed within the carrying case. The carrying case, or bag, has several pockets which may be used for the convenient storage of other items. The pockets are easily accessible when the playyard is folded and stored within the carrying case. The carrying case may be opened into a substantially flat configuration and attached to an unfolded or open playyard with the pockets exposed to the user and remaining easily accessible. The end flaps of the carrying case are partially removable to facilitate the opening to a substantially flat configuration.

20 Claims, 3 Drawing Sheets

PORTABLE PLAYYARD STORAGE SYSTEM

BACKGROUND OF THE INVENTION

1. Field of the Invention

The present invention relates to an improved portable playyard storage system, and more particularly to such a system that can be conveniently adapted to store the playyard and other items both during transportation of the playyard and when the playyard is in use.

2. Description of the Related Art

Conventional playyards can be seen, for example, in U.S. Pat. No. 4,811,437 to Dillner et al. When not in use, the entire playyard folds into a compact, generally rectangular structure. Typically, a rectangular-shaped nylon or plastic zippered storage bag is provided to store the folded playyard. However, conventional playyard storage bags, such as that disclosed in Dillner et al., fail to provide a convenient means to allow a person carrying the playyard to also simultaneously transport other items.

SUMMARY OF THE INVENTION

Accordingly, the present invention is directed to a portable playyard storage system that substantially obviates one or more of the problems due to limitations and disadvantages of the related art.

An object of the present invention is to provide a storage system for a portable playyard system that conveniently allows the user to transport other items.

Another object of the present invention is to provide such a storage system that can convert from a carrying case for the folded playyard to a storage system which is conveniently attachable to the unfolded playyard while maintaining the ability to transport and store other items.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, the invention provides for a portable playyard system with added storage features comprising a playyard structure which collapses into a generally rectangular shape, and a carrying case adapted to hold the playyard structure having a plurality of pockets for storing items disposed on a first and a second a side portion of the carrying case, the carrying case being adapted to be opened into a substantially flat configuration and to connect to the playyard to expose the plurality of pockets away from the playyard.

In another aspect, the invention provides for a carrying case for a portable playyard system, comprising a rectangular shaped body, a plurality of pockets for storing items disposed on the body, a first and a second end, each permanently connected to the body at a connection portion and removably connected to the body at a removable portion of the body such that the body may be opened into a substantially flat configuration to expose the plurality of pockets when both ends are disconnected from the body at the removable portion of the body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention and together with the description serve to explain the principles of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
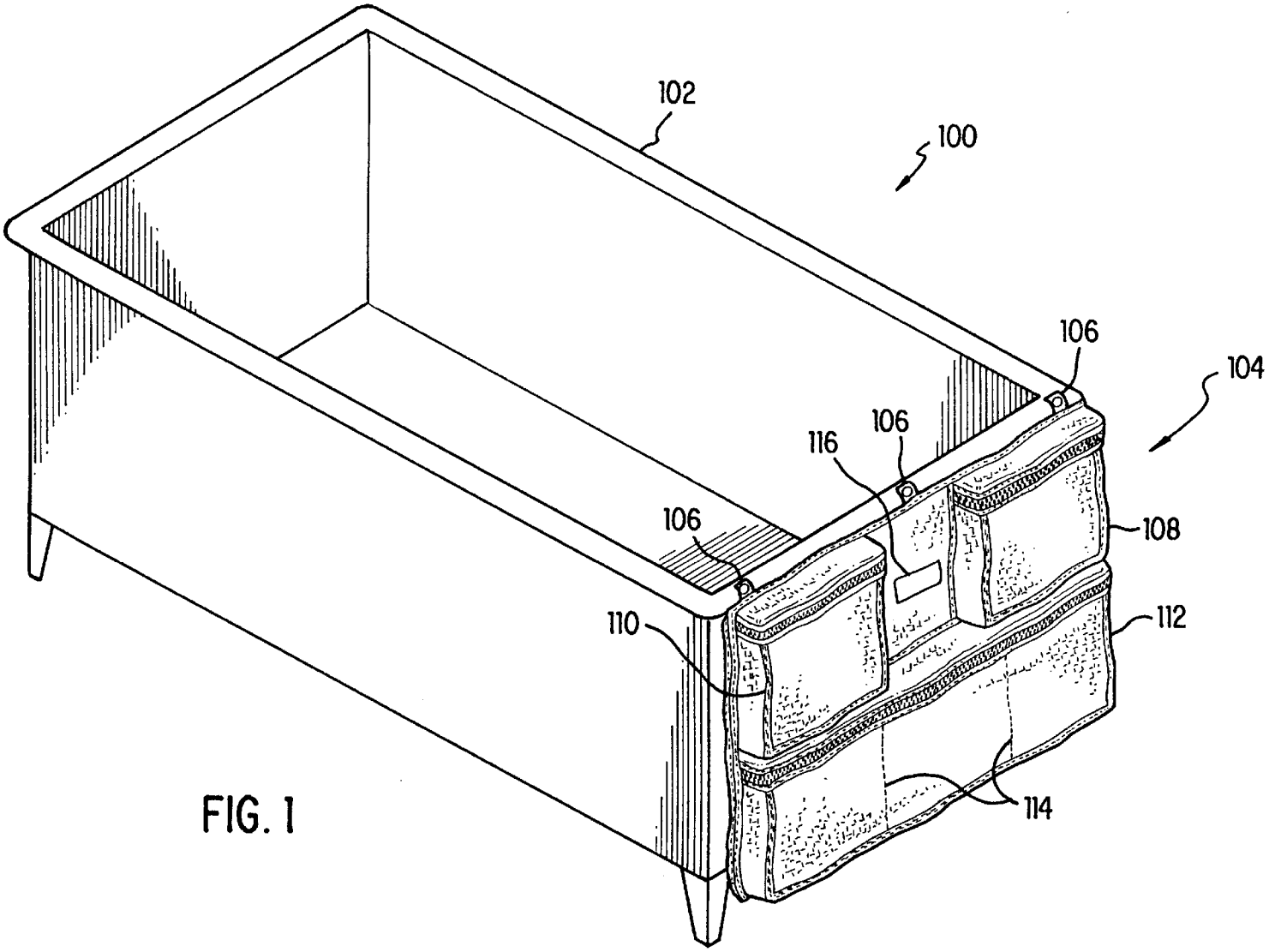
FIG. 1 is a perspective view of a playyard in the unfolded or open position with the storage system according to the present invention attached thereto and folded in a substantially flat configuration with several pockets exposed.

The invention is directed to a portable playyard system with added storage features. As shown in FIG. 1, a playyard system 100 includes a playyard 102, which could be of any of several types, and a carrying case 104 having a plurality of pockets. The carrying case 104 is made, for example, of a woven nylon material and is adapted to connect to the playyard 102. As shown in FIG. 1, the carrying case 104 is opened into a substantially flat configuration and connected to the playyard 102 to expose the plurality of pockets away from the playyard 102.

Preferably, the carrying case 104 includes a means for connection to the side of the playyard 100. In the embodiment shown in FIG. 1, the connection means includes three snaps 106, which are connected to the playyard 102 at appropriate buttons (not shown) located below the upper side rail. As an alternate embodiment, the connection means can include a pair of cloth loops (not shown) at opposite ends of the top edge of the substantially flat carrying case 104. The cloth loops could then be passed over the top rail of the playyard 102 to secure the carrying case 104 thereto. A hook and loop fastener, ties, or other device known in the art could be utilized to secure the cloth loops. In the preferred embodiment, the carrying case 104 is connected to a shorter side of the playyard 102.

As described above, the carrying case 104 includes a plurality of pockets for storing items. It will be appreciated that such pockets maybe useful for storing food or clothing associated with a child. A right upper pocket 108 and a left upper pocket 110 are shown in the carrying case 104 in FIG. 1. A lower pocket 112 is also shown, and preferably includes a pair of dividers 114 to divide the lower pocket into three smaller sections.

Each of the pockets preferably includes a means for closing the pocket. The closing means is preferably easily operated by a user when the carrying case 104 is connected to the playyard 102 to allow ready access to items stored in any of the pockets 108, 110, and 112. A preferred closing means includes a zipper, such that the pocket 108 is closed with a zipper 208, pocket 110 is closed with a zipper 210, and pocket 112 is closed with a zipper 212.

The carrying case 104 defines a handle opening 116 disposed between the upper right pocket 108 and the upper left pocket 110. As shown in FIG. 1, the handle opening 116 is generally rectangular in shape, and is adapted to receive a carrying handle of the playyard 102 in its folded configuration. The carrying handle 213 can extend through the handle opening 116 for access by the user, who can conveniently simultaneously lift both the folded playyard and the carrying case (see FIG. 2).

Figure 2:
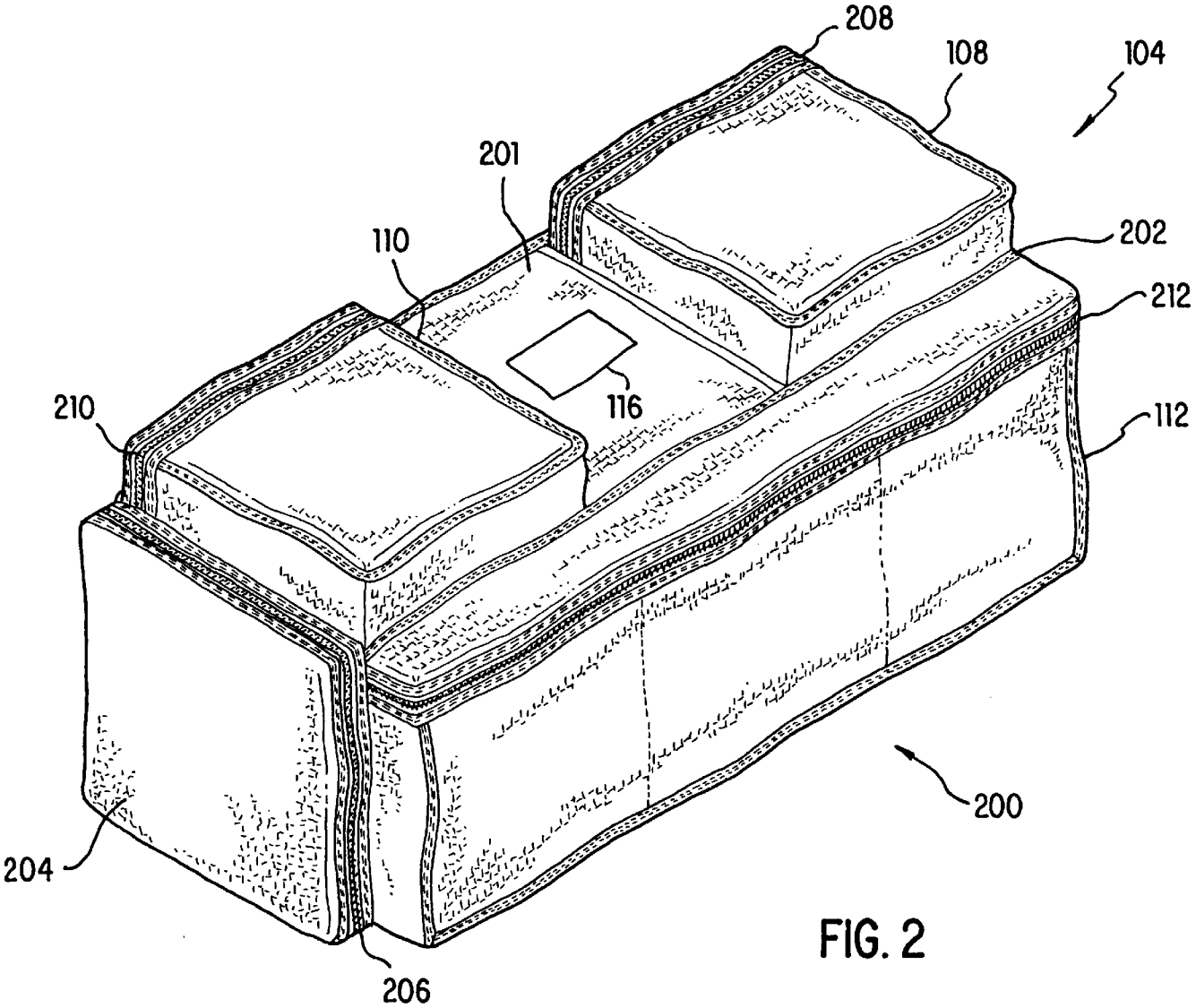
FIG. 2 is a perspective view of the storage system according to the present invention storing a playyard in the folded position.

FIG. 2 shows the carrying case 104 in a generally rectangular configuration with a folded playyard stored inside. The preferred carrying case 104 as shown is preferably utilized with a hub-type playyard, such as that described in U.S. Pat. No. 4,811,437 to Dillner et al.

FIG. 2 shows the carrying case 104 with a rectangular shaped body 200 including four side portions, of which a first side portion 201 with pockets 108 and 110, and a second side portion 202 with pocket 112 are shown in FIG. 2. The carrying case 104 further includes two end portions, of which an end piece 204 is shown in FIG. 2, which are partially connected to the body 200 with a permanent connection to the body 200 at a connection portion, and a removable connection to the body at a removable portion. End piece 204 preferably is removably connected to the body 200 by a zipper 206. Zipper 206 extends along three sides of the end piece 204 to allow for the removal of the end piece from that portion of the carrying case 104. Preferably, the zipper 206 extends along the back side of the body (not shown), the first side 201, and the second side 202. The bottom edge of the end piece is preferably permanently connected to the body 200 of the carrying case 104. For example, the material of the body could simply extend from the bottom side of the body to form the end piece 204.

Figure 3:
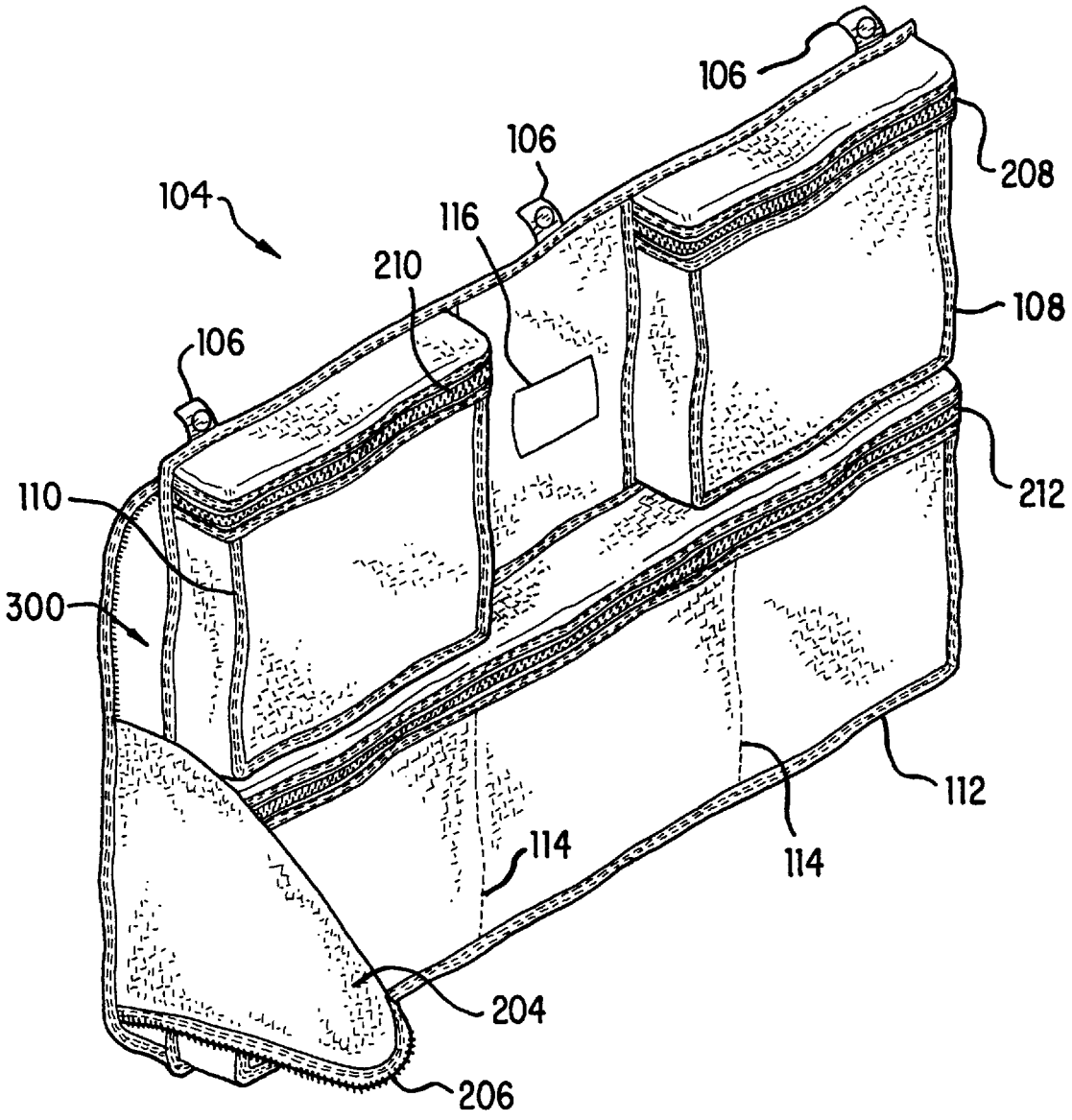
FIG. 3 is a perspective view of the storage system according to the present invention in a partially opened configuration showing an end piece folded inside.

In accordance with the present invention, the invention provides a carrying case adapted to be opened into a substantially flat configuration. As shown in FIG. 3, the carrying case 104 is shown in an intermediate configuration between the generally rectangular shape (FIG. 2) used for storing the playyard 102, and the substantially flat configuration (FIG. 1) adapted for connection to the playyard 102. In particular, FIG. 3 shows the carrying case 104 with the end piece 204 disconnected from the body of the carrying case through the unzipping of the zipper 206. The end piece is shown as a loose flap connected to the carrying case 104. To transform the carrying case 104 to a substantially flat configuration, the end piece 204 is tucked into the opening 300 shown in FIG. 3. The end piece 204 is then smoothed flat within the opening and the carrying case 104 is then suspended by the connection means 106. It should be understood that the opposite end piece (not shown) can be unzipped, inserted into a corresponding opening, and smoothed flat to complete the transformation.

To transform the carrying case from the substantially flat configuration to a generally rectangular configuration, the process just described is reversed by withdrawing the end pieces from the opening 300, and closing the zipper 206. The playyard 102 may be inserted into the generally rectangular configured carrying case 104 by unzipping one of the end pieces, such as end piece 204, inserting the folded playyard 102, and then zipping the end piece closed.

It will be apparent to those skilled in the art that various modifications and variations can be made in the portable playyard system of the present invention without departing from the spirit or scope of the invention. Thus, it is intended that the present invention cover the modifications and variations of this invention provided they come within the scope of the appended claims and their equivalents.

What is claimed is:

1. A portable playyard system, comprising:

a playyard structure adapted to be folded into a generally rectangular shape; and a carrying case adapted to hold the playyard structure, the carrying case having a plurality of pockets and at least one connector, and the carrying case being adapted to be opened into a substantially flat configuration and to be connected to the playyard structure via the at least one connector to expose the plurality of pockets facing away from the playyard structure.

2. The portable playyard system of claim 1, wherein the carrying case comprises a flexible bag having a generally rectangular shape with partially detachable end pieces which allow the bag to be opened into a substantially flat configuration when the end pieces are partially detached.

3. The portable playyard system of claim 1, wherein the playyard structure includes a carrying handle, and wherein a side portion of the carrying case defines a handle opening to receive the carrying handle.

4. The portable playyard system of claim 1, wherein one of the plurality of pockets includes a means for closing the one pocket.

5. The portable playyard system of claim 4, wherein the closing means includes a zipper.

6. The portable playyard system of claim 1, wherein the plurality of pockets include a first and a second pocket disposed on a first side of the carrying case, and a third pocket disposed on a second side of the carrying case.

7. The portable playyard system of claim 1, wherein the carrying case is adapted to be connected to a side of the playyard structure.

8. The portable playyard system of claim 7, wherein the at least one connector comprises a plurality of snaps disposed along a side of the playyard structure and a corresponding plurality of buttons disposed along an edge of the carrying case.

9. The portable playyard system of claim 7, wherein the at least one connector comprises a plurality of straps disposed along an edge of the carrying case.

10. The portable playyard system of claim 1, wherein the carrying case is comprised of a woven nylon material.

11. A portable playyard system, comprising:

a playyard structure adapted to be folded into a generally rectangular shape; and a carrying case adapted to hold the playyard structure, the carrying case having a plurality of pockets and connection means for connecting the carrying case to the playyard structure, and the carrying case being adapted to be opened into a substantially flat configuration and to be connected to the playyard structure via the connecting means to expose the plurality of pockets facing away from the playyard structure.

12. The portable playyard system of claim 11, wherein the carrying case comprises a flexible bag having a generally rectangular shape with partially detachable end pieces which allow the bag to be opened into a substantially flat configuration when the end pieces are partially detached.

13. The portable playyard system of claim 11, wherein the playyard structure includes a carrying handle, and wherein a side portion of the carrying case defines a handle opening to receive the carrying handle.

14. The portable playyard system of claim 11, wherein one of the plurality of pockets includes a means for closing the one pocket.

15. The portable playyard system of claim 14, wherein the closing means includes a zipper.

16. The portable playyard system of claim 11, wherein the plurality of pockets include a first and a second pocket disposed on a first side of the carrying case, and a third pocket disposed on a second side of the carrying case.

17. The portable playyard system of claim 11, wherein the carrying case is adapted to be connected to a side of the playyard structure.

18. The portable playyard system of claim 11, wherein the connecting means includes a plurality of snaps disposed along a side of the playyard structure and a corresponding plurality of buttons disposed along an edge of the carrying case.

19. The portable playyard system of claim 11, wherein the connecting means includes a plurality of straps disposed along an edge of the carrying case.

20. The portable playyard system of claim 11, wherein the carrying case is comprised of a woven nylon material.

* * * * *